US010099484B2

(12) United States Patent
Govyadinov et al.

(10) Patent No.: US 10,099,484 B2
(45) Date of Patent: Oct. 16, 2018

(54) PRINT HEAD SENSING CHAMBER CIRCULATION

(71) Applicant: HEWLETT-PACKARD DEVELOPMENT COMPANY, L.P., Houston, TX (US)

(72) Inventors: Alexander Govyadinov, Corvallis, OR (US); Adam L Ghozeil, Corvallis, OR (US); Boon Bing Ng, Singapore (SG); Patrick Leonard, Leixlip (IE); Raymond Connolly, Leixlip (IE)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/520,338

(22) PCT Filed: Oct. 30, 2014

(86) PCT No.: PCT/US2014/063214
§ 371 (c)(1),
(2) Date: Apr. 19, 2017

(87) PCT Pub. No.: WO2016/068954
PCT Pub. Date: May 6, 2016

(65) Prior Publication Data

US 2017/0313093 A1 Nov. 2, 2017

(51) Int. Cl.
*B41J 2/175* (2006.01)
*B41J 2/18* (2006.01)

(52) U.S. Cl.
CPC ..... *B41J 2/17566* (2013.01); *B41J 2/18* (2013.01)

(58) Field of Classification Search
CPC ..... B41J 2/17566; B41J 2/18
USPC ..... 347/7
See application file for complete search history.

(56) References Cited

U.S. PATENT DOCUMENTS

| | | | | |
|---|---|---|---|---|
| 4,462,037 | A * | 7/1984 | Bangs | B41J 2/17566 347/85 |
| 4,610,202 | A * | 9/1986 | Ebinuma | B41J 2/175 101/364 |
| 5,886,713 | A | 3/1999 | Okada et al. | |
| 5,966,144 | A | 10/1999 | Edwards | |
| 6,398,329 | B1 | 6/2002 | Boyd et al. | |
| 2005/0001863 | A1 | 1/2005 | Farr et al. | |
| 2006/0071985 | A1 | 4/2006 | Therien et al. | |

(Continued)

FOREIGN PATENT DOCUMENTS

| | | | |
|---|---|---|---|
| CN | 102971150 | A1 | 3/2013 |
| EP | 0764538 | A2 | 3/1997 |
| WO | WO-2014084843 | | 6/2014 |

OTHER PUBLICATIONS

Reverter, et al. "Liquid-level Measurement System Based on a Remote Grounded Capacitive Sensor" Mar. 21, 2007.

*Primary Examiner* — Huan Tran
*Assistant Examiner* — Alexander D Shenderov
(74) *Attorney, Agent, or Firm* — HP Inc. Patent Department

(57) ABSTRACT

A print head has an ink slot and a sensing chamber having a first port connected to the fluid slot and a second port. The sensing chamber contains an ink level sensor. A recirculation passage extends from the fluid slot and is fluidly coupled to the second port. A fluid pump circulates fluid through the recirculation passage.

14 Claims, 7 Drawing Sheets

(56) References Cited

U.S. PATENT DOCUMENTS

| | | | |
|---|---|---|---|
| 2009/0058914 | A1 | 3/2009 | Kim et al. |
| 2011/0128335 | A1 | 6/2011 | Von Essen et al. |
| 2013/0155152 | A1 | 6/2013 | Govyadinov et al. |
| 2013/0278688 | A1 | 10/2013 | Bibl |
| 2014/0085363 | A1 | 3/2014 | Van Brocklin et al. |
| 2014/0204148 | A1 | 7/2014 | Ge et al. |

* cited by examiner

PRINT HEAD SENSING CHAMBER CIRCULATION

BACKGROUND

The level or amount of fluid or ink available to a print head is sometimes detected by employing a sensor located on the print head. When the print head is being used while not being capped, water may evaporate from fluid or ink adjacent the sensor. The water loss from the fluid may impair performance of the sensor.

DETAILED DESCRIPTION OF EXAMPLES

Figure 1:
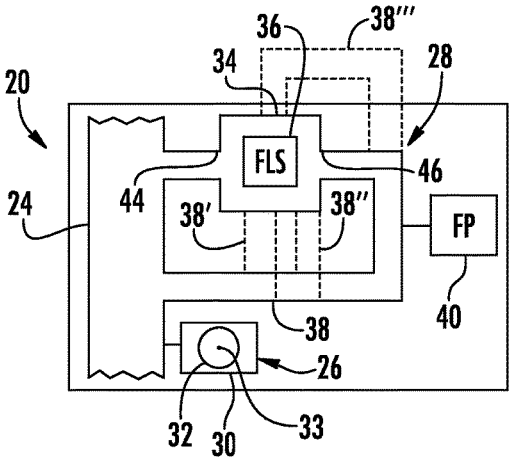
FIG. 1 is a schematic diagram of an example print head.

FIG. 1 schematically illustrates an example print head 20. As will be described hereafter, print head 20 utilizes a sensor to detect fluid levels of the print head. Print head 20 circulates fluid, such as ink, to the sensor to refresh the fluid contained adjacent the sensor and sensed by the sensor. As a result, the useful life or performance of the sensor is enhanced. Print head 20 comprises a fluid slot 24, drop generator 26 and fluid level sensing system 28.

Fluid slot 24 comprises slot by which fluid, such as ink, is applied to and delivered to drop generator 26 associated with print head 20. In one implementation, fluid slot 24 is formed in a substrate, such as a silicon substrate. In one implementation, fluid slot 24 extends along a column of drop generator 26, wherein fluid slot 24 supplies fluid, such as ink, to each of the drop generators of the column.

Drop generator 26 comprises a drop-on-demand device that generates individual droplets of fluid and expel such droplets of liquid fluid in a controlled manner. In the example illustrated, drop generator 26 comprises a print firing chamber 30 and a firing element 32 within or adjacent chamber 30. Chamber 30 is fluidically coupled to fluid in slot 24 so as to receive fluid or ink from slot 24. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "fluidly coupled" shall mean that two are more fluid transmitting volumes are connected directly to one another or are connected to one another by intermediate volumes or spaces such that fluid may flow from one volume into the other volume.

Chamber 30 Extends adjacent a nozzle opening 33, wherein the firing element 32 comprises a device capable of operating to eject fluid drops through the nozzle opening 33. In one example, drop generator 26 comprises a thermoresistive drop-on-demand inkjet device, wherein firing element 32 comprising resistor (by, for example, a thin film transistor) and wherein an electric current to selectively applied to firing element 32 such sufficient heat is generated to vaporize liquid, creating a bubble that forcefully ejects remaining liquid in the chamber 30 through the nozzle opening 33. In one implementation, the firing element 32 may comprise a thermoresistive firing element which may employ a thermal resistor formed on an oxide layer on a top surface of a substrate and a thin-film stack applied on top of the oxide layer, and the thin-film second as a metal layer defining the firing element, conductive traces and a passivation layer.

In yet another implementation, drop generator 26 comprises a piezoelectric drop-on-demand inkjet device, wherein firing element 26 comprising a piezoelectric member (by, for example, a thin-film transistor) and wherein electric current is selectively applied to firing element 32 to deflect a diaphragm that forcefully ejects remaining liquid within the chamber through a nozzle. In yet other implementations, drop generator 26 comprises other forms of presently available or future developed liquid drop generators.

Fluid level sensing system 28 senses parameters which indicate the level of ink or fluid. In one implementation, fluid level sensing system 28 senses primers which indicate level of anger fluid within fluid slot 24 which is being supplied to drop generators 26. Fluid level sensing system 28 comprises sensing chamber 34, fluid level sensor 36, circulation passage 38 and fluid pump 40.

Sensing chamber 34 comprises a chamber or volume carried by the print head 20 which contains fluid level sensor 36. In one implementation, sensing chamber 34 is formed within a substrate in which fluid slot 24 is also formed. Sensing chamber 34 comprises a first port 44 fluidically coupled to fluid slot 24 and a second port 46 distinct from port 44. Ports 44 and 46 facilitate the flow of fluid across fluid level sensor 36. Although ports 44 and 46 are illustrated as extending on opposite sides of sensing chamber 34 and as facing one another, in other implementations, such ports 44 and 46 may be in other locations. For example, in other implementations, ports 44 and 46 may extend along adjacent faces such that ports 44 and 46 extend perpendicular to one another.

Sensing chamber 34 receives fluid from fluid slot 24, wherein fluid level sensor 36 senses one or more characteristics of the received fluid to identify a level of fluid contained within print head 20, such as a level fluid within fluid slot 24 that is being supplied to drop generator 26. In one implementation, fluid level sensor 36 senses the level fluid by sensing changes in capacitance caused by changes in the level of fluid within sensing chamber 34. In other implementations, fluid level sensor 36 senses fluid levels in other fashions.

Circulation passage 38 comprises a channel, conduit or other passage along which fluid flows or circulates. Circulation passage 38 extends from fluid slot 24 to port 46. Circulation passage 38 facilitates the circulation of fluid from fluid slot 24 into sensing chamber 34, across fluid level sensor 36 and out of sensing chamber 34 through port 44 back into fluid slot 24. As indicated by broken lines, which illustrate alternative passages 38', 38" and 38'", circulation passage 38 may have various shapes and routings.

Fluid pump 40 comprises a device located so as to pump and circulate fluid through circulation passage 38 and through sensing chamber 34 across fluid level sensor 36. In one implementation, fluid pump 40 is located within circulation passage 36. In another implementation, fluid pump 40 comprises an electrical resistor which upon receiving electric current, heats up to vaporize fluid, creating a bubble which drives and pumps adjacent fluid along circulation passage 38. In yet another implementation, fluid pump 40 comprises other micro pumping devices, such as piezoelectric device, wherein a diaphragm is deflected to forcefully eject or pump fluid or liquid long circulation passage 38.

When print head 20 is operating but not being capped, water may evaporate from the ink or fluid within sensing chamber 34. Such water loss during decap periods may result in various decap induced issues such as pigment-ink-vehicle separation, viscous plug formation, weak bubble drive, latex-ink-vehicle separation and/or wax-ink-vehicle separation. As a result, performance of the sensor may be reduced. Fluid pump 40 circulates or re-circulates fluid through circulation passage 38 across fluid level sensor 36 to constantly or periodically refresh fluid in sensing chamber 34. As a result, the useful life and/or perform of the fluid level sensor 36 is enhanced.

Figure 2:
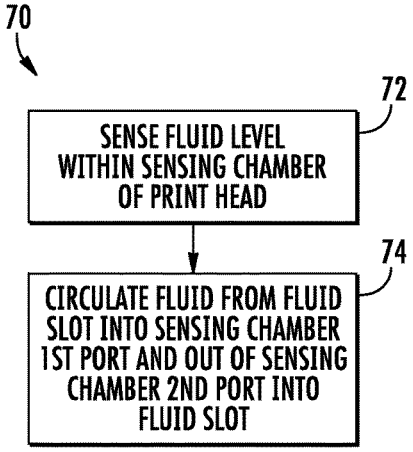
FIG. 2 is a flow diagram of an example method for circulating fluid across a sensing chamber.

FIG. 2 is a flow diagram of an example method 70 for operating a print head. In one implementation, method 70 is carried out using print head 20 of FIG. 1. As indicated by block 72, fluid level sensor 36 senses fluid level within sensing chamber 34 of print head 20. As noted above, in one implementation, fluid level sensor 36 senses a capacitance value which corresponds to or which changes based upon the level of fluid or ink within sensing chamber 34. The level of fluid or ink within sensing chamber 34 corresponds to the level of fluid within fluid slot 24 that is being supplied to drop generator 26. In another implementation, fluid level sensor 36 detects the level of fluid within sensing chamber 34 and fluid slot 24 in other fashions.

As indicated by block 74, fluid pump 40 circulates fluid from fluid slot 24 into sensing chamber 34 through the first port 46. Fluid or ink currently residing in sensing chamber 34, which may have undergone evaporation and water loss, is circulated or driven out of sensing chamber 34 through the second port 44 back into fluid slot 24 where is mixed with fluid or ink having higher levels of water. Because the fluid or ink residing in sensing chamber 34 is refreshed with ink or fluid from fluid slot 24 having higher levels of water, fluid level sensor 36 is less likely to experience various decap induced issues. As a result, performance of fluid level sensor 36 is enhanced.

Figure 3:
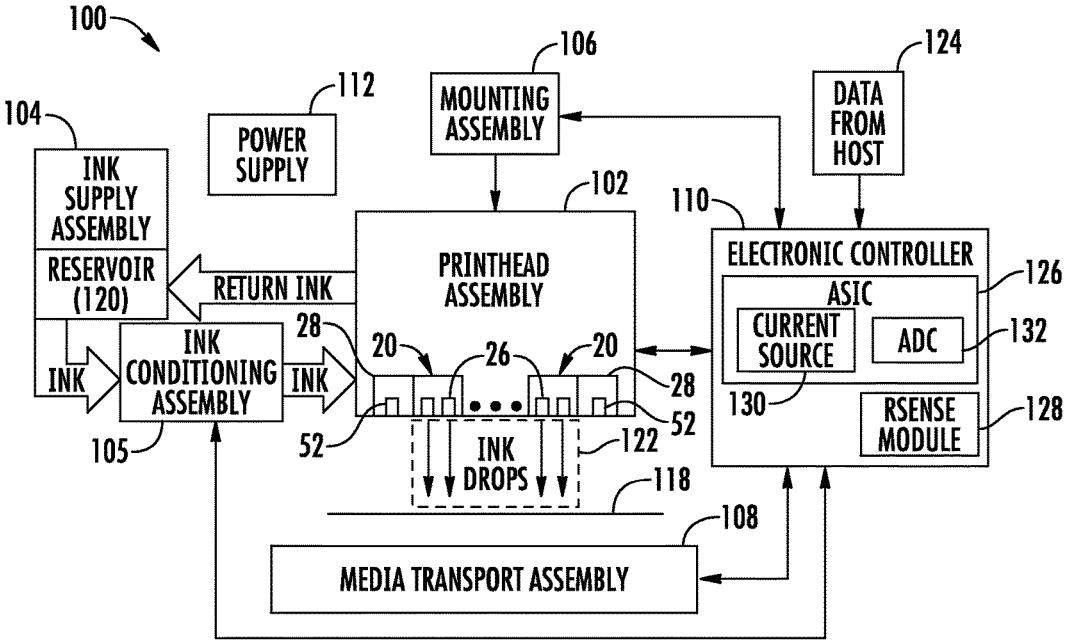
FIG. 3 is a schematic diagram of an example printing system including the printing system of FIG. 1.

FIG. 3 schematically illustrates an example printing system 100 incorporating print heads 20. Printing system 100 comprises an inkjet print head assembly 102, an ink supply assembly 104, a mounting assembly 106, a media transport assembly 108, an electronic printer controller 110, and at least one power supply 112 that provides power to the various electrical components of inkjet printing system 100. Inkjet print head assembly 102 includes print heads 20. Each of print heads 20 comprises a plurality of drop generators 26 which are control to selectively eject drops of ink through a plurality of orifices or nozzles toward a print medium 118 so as to print onto print media 118. Print media 118 can be any type of suitable sheet or roll material, such as paper, card stock, transparencies, polyester, plywood, foam board, fabric, canvas, and the like. In the example illustrated, such drop generators 26 and their associated nozzles are arranged in one or more columns or arrays such that properly sequenced ejection of ink from nozzles causes characters, symbols, and/or other graphics or images to be printed on print media 118 as inkjet print head assembly 102 and print media 118 are moved relative to each other.

As further schematically shown by FIG. 3, each print head 20 further comprises fluid level sensing system 28, described above. In the example illustrated, each fluid level sensing system 28 comprises a fluid level sensor 36 disposed within a sensing chamber 34 (described above with respect to FIG. 1) which has two ports, each port being fluidly coupled to a fluid slot 24 (shown in FIG. 1). Each fluid level sensing system 28 further comprises a fluid pump 40 (shown in FIG. 1) that circulates fluid within circulation passage 38 either continuously or periodically through sensing chamber 34 to refresh the fluid contained opposite to fluid level sensor 36. In the example illustrated, each fluid level sensing system 28 additionally comprises a drop generator 52 that purges ink residue from the sensing chamber 34 (shown in 1).

Ink supply assembly 104 supplies fluid ink to print head assembly 102 and includes a reservoir 120 for storing ink. Ink flows from reservoir 120 to inkjet print head assembly 102. Ink supply assembly 104 and inkjet print head assembly 102 can form either a one-way ink delivery system or a recirculating ink delivery system. In a one-way ink delivery system, substantially all of the ink supplied to inkjet print head assembly 102 is consumed during printing. In a recirculating ink delivery system, however, only a portion of the ink supplied to print head assembly 102 is consumed during printing. Ink not consumed during printing is returned to ink supply assembly 104.

In one embodiment, ink supply assembly 104 supplies ink under positive pressure through an ink conditioning assembly 105 to inkjet print head assembly 102 via an interface connection, such as a supply tube. Ink supply assembly 104 includes, for example, a reservoir, pumps and pressure regulators. Conditioning in the ink conditioning assembly 105 may include filtering, preheating, pressure surge absorption, and degassing. Ink is drawn under negative pressure from the print head assembly 102 to the ink supply assembly 104. The pressure difference between the inlet and outlet to the print head assembly 102 is selected to achieve the correct backpressure at the nozzles 116, and is usually a negative pressure between negative 1" and negative 10" of $H_2O$. Reservoir 120 of ink supply assembly 104 may be removed, replaced, and/or refilled.

Mounting assembly 106 positions inkjet print head assembly 102 relative to media transport assembly 108, and media transport assembly 108 positions print media 118 relative to inkjet print head assembly 102. Thus, a print zone 122 is defined adjacent to the nozzles of drop generators 26 in an area between inkjet print head assembly 102 and print media 118. In one embodiment, inkjet print head assembly 102 is a scanning type print head assembly. As such, mounting assembly 106 includes a carriage for moving inkjet print head assembly 102 relative to media transport assembly 108 to scan print media 118. In another embodiment, inkjet print head assembly 102 is a non-scanning type print head assembly. As such, mounting assembly 106 fixes inkjet print head assembly 102 at a prescribed position relative to media transport assembly 108. Thus, media transport assembly 108 positions print media 118 relative to inkjet print head assembly 102.

Electronic printer controller 110 typically includes a processor, firmware, software, one or more memory components including volatile and no-volatile memory components, and other printer electronics for communicating with and controlling inkjet print head assembly 102, mounting assembly 106, and media transport assembly 108. Electronic controller 110 receives data 124 from a host system, such as a computer, and temporarily stores data 124 in a memory. In one implementation, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one implementation, electronic printer controller 110 controls inkjet print head assembly 102 for ejection of ink drops. Thus, electronic controller 110 defines a pattern of ejected ink drops that form characters, symbols, and/or other graphics or images on print media 118. The pattern of ejected ink drops is determined by the print job commands and/or command parameters from data 124. In one embodiment, electronic controller 110 includes a printer application specific integrated circuit (ASIC) 126 and a resistance-sense firmware module 128 executable on ASIC 126 or controller 110. Printer ASIC 126 includes a current source 134 and an analog to digital converter (ADC) 132. ASIC 126 can convert the voltage present at current source 134 to determine a resistance, and then determine a corresponding digital resistance value through the ADC 132. A programmable algorithm implemented by the resistance-sense module 128 enables the resistance determination and the subsequent digital conversion through the ADC 132.

In one implementation, printing system 100 comprises a drop-on-demand thermal inkjet printing system with a thermal inkjet (TIJ) print head 20 suitable for implementing a fluid level sensing system 28 as disclosed herein. In one implementation, inkjet print head assembly 102 includes a single TIJ print head 20. In another implementation, inkjet print head assembly 102 includes a wide array of TIJ print heads 20. While the fabrication processes associated with TIJ print heads are well suited to the integration of the ink level sensor, other print head types such as a piezoelectric print head can also implement such a fluid level sensing system 28. The disclosed fluid level sensing system 28 is not limited to implementation in a TIJ print head 20.

Figure 4:
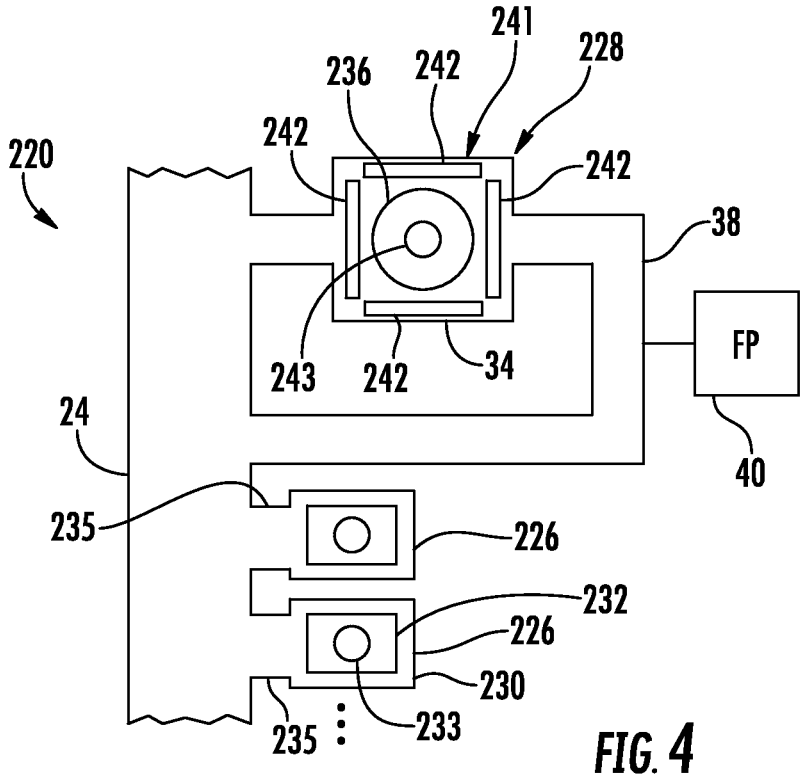
FIG. 4 is a schematic diagram of an example implementation of a print head of the printing system of FIG. 3.

FIG. 4 schematically illustrates print head 220, an example implementation of print head 20 described with respect to FIG. 1. In one implementation, print head 220 is utilized as part of printing system 100 in place of each of the illustrated print heads 20. Print head 220 is similar to print head 20 except that print head 220 is illustrated as specifically comprising drop generators 226 in lieu of drop generator 26 and fluid level sensing system 228 in lieu of fluid level sensing system 28. As shown by FIG. 4, print head 220 comprises a series or column of multiple drop generators 226. In the example illustrated, each drop generator 226 comprises a print firing chamber 230, a thermoresistive firing element 232 disposed within or adjacent the print firing chamber 230 and a nozzle opening 233. Print firing chamber 230 is in fluid connection with fluid slot 24 via port 235 so as to receive fluid or ink from fluid slot 24. Firing element 232 is selectively supplied with electrical current such produce heat to vaporize adjacent fluid, creating a vapor bubble, to forcefully expel remaining fluid through nozzle opening 232. When the heated firing element 232 cools, the vapor bubble quickly collapses, drawing more fluid from fluid slot 24 into the firing chamber 230 in preparation for ejecting another drop from the nozzle 233.

Similar to fluid level sensing system 28, fluid level sensing system 228 senses the level of fluid or ink and circulates fluid across a fluid sensor to maintain or enhance operational performance of the fluid level sensor. Fluid level sensing system 228 is similar to fluid level sensing system 28 described above except that fluid level sensing system 228 comprises fluid level sensor 236, an implementation a fluid level sensor 36, and additionally comprises a drop generator 241 including fluid firing elements 242 and nozzle opening 243. Those remaining elements or components of fluid level sensing system 228 which correspond to components of fluid level sensing system 28 are numbered similarly.

Drop generator 241 expels or purges fluid or ink residue from sensing chamber 34. In the example illustrated, drop generator 241 comprises four exposed firing elements 242 that expel such anchor fluid residue through nozzle opening 243. In the example illustrated, firing elements 242 comprise thermoresistive firing elements, comprising resistors that heat up upon receiving electrical current so as to vaporize liquid or fluid to create a bubble that forcefully expels remaining fluid through nozzle opening 243. In other implementations, firing elements 242 comprise piezoelectric firing elements that upon receiving electrical current, change shape so as to move a diaphragm which forcefully expels remaining fluid through nozzle opening 243. In yet other implementations, drop generator 241 may have other configurations or may be omitted.

Fluid level sensor 236 senses level of fluid currently being supplied by fluid slot 24 and contained within reservoir 120 (shown in FIG. 3). In the example illustrated, fluid level sensor 236 senses a capacitance value which corresponds to or which changes based upon the level of fluid or ink within sensing chamber 34 which corresponds to the level of ink being supplied by fluid slot 24. In other implementations, fluid level sensor 236 may sense the level of fluid being supplied by fluid slot 24 in other fashions.

Figure 5:
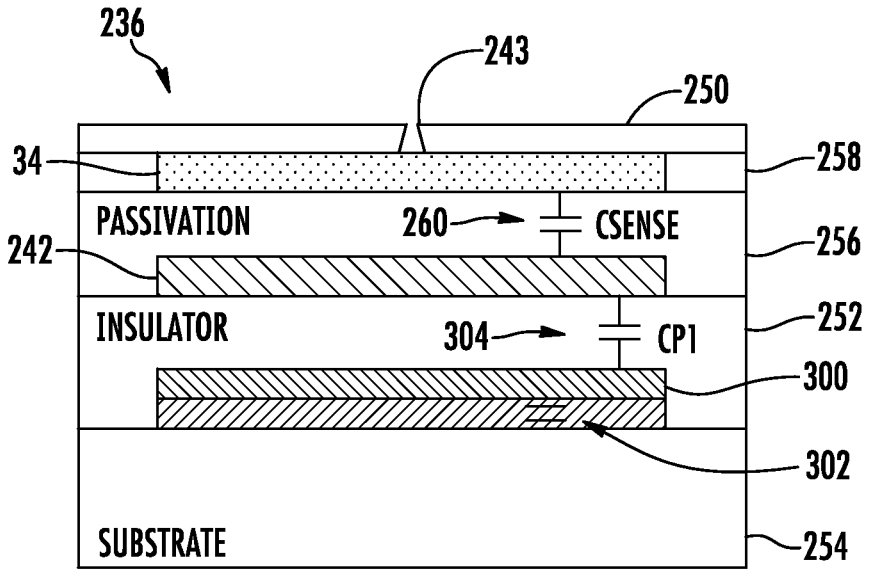
FIG. 5 is a sectional view of an example implementation of a fluid level sensor of the print head of FIG. 3.

FIG. 5 is a sectional view of drop generator 241 and fluid level sensor 236. As shown by FIG. 5, drop generator 241 comprises nozzle 243, sensing chamber 34, and a firing element 242 disposed in the sensing chamber 34. Nozzle 243 is formed in nozzle layer 250. Firing element 242 is a thermal resistor formed of a metal plate (e.g., tantalum-aluminum, TaAl) on an insulating layer 252 (e.g., polysilicon glass, PSG) on a top surface of the silicon substrate 254. A passivation layer 256 over the firing element 242 protects the firing element 242 from fluid or ink in chamber 34 and acts as a mechanical passivation or protective cavitation barrier structure to absorb the shock of collapsing vapor bubbles. A chamber layer 258 has walls and chamber 34 that separate the substrate 254 from the nozzle layer 250.

Fluid level sensor 236 comprises an ink level sensor circuit, portions of which are integrated on the print head 220. In addition to those portions that are integrated on print head 220, fluid level sensor 236 incorporates current source 130 and analog to digital convertor (ADC) 132 from a printer ASIC 126 (shown in FIG. 3) that is not integrated on the print head 220. Instead, the printer ASIC 126 is located, for example, on the printer carriage or electronic controller of the printer system 100.

As further shown FIG. 5, the ink level sensor circuit forming fluid level sensor 236 incorporates a sense capacitor (Csense) 260. In the example illustrated, sense capacitor 260 is formed by the metal plate forming firing element 242, the passivation layer 256, and the substance or contents of the chamber 34. The value of the sense capacitor 260 changes as the substance within the chamber 34 changes. The substance in the chamber 34 can be all ink, ink and air, or just air. Thus, the value of the sense capacitor 260 changes with the level of ink in the chamber 34. When ink or fluid is present in the chamber 34, the sense capacitor 260 has good conductance to ground so the capacitance value is highest (i.e., 100%). However, when there is no fluid or ink in the chamber 34 (i.e., air only) the capacitance of sense capacitor 260 drops to a very small value, which is ideally close to zero. When the chamber contains ink and air, the capacitance value of sense capacitor 260 is somewhere between zero and 100%. Using the changing value of the sense capacitor 260, the fluid level sensor 136 is able to determine the ink level. In general, the ink level in the chamber 34 is indicative of the level of ink in reservoir 120 of printer system 100. In some implementations, prior to measuring the ink level with fluid level sensor 236, firing element 242 is used to purge ink residue from the chamber 34. Thereafter, to the extent that fluid are ink is present in the reservoir 120, such fluid or ink flows back into the chamber to enable an accurate ink level measurement.

In the example illustrated, fluid level sensor 236 additionally comprises a parasitic elimination element 300. In other implementations, parasitic elimination element 300 is omitted. The parasitic elimination element is a conductive layer 300 such as a poly silicon layer designed to eliminate the impact of the parasitic capacitance Cp1 304. In this design, when a voltage (i.e., Vp) is applied to the metal plate 242, it is also applied to the conductive layer 300. This prevents a charge from developing on the Cp1 304 so that Cp1 is effectively removed/isolated from the determination of the sense capacitor 260 capacitance. Cp2, element 302, is the intrinsic capacitance from the parasitic elimination element 300 (conductive poly layer 300). Cp2 302 slows the charging speed of the parasitic elimination element 300 but has no impact on the removal/isolation of Cp1 304 because there is sufficient charge time provided for element 300.

Figure 6:
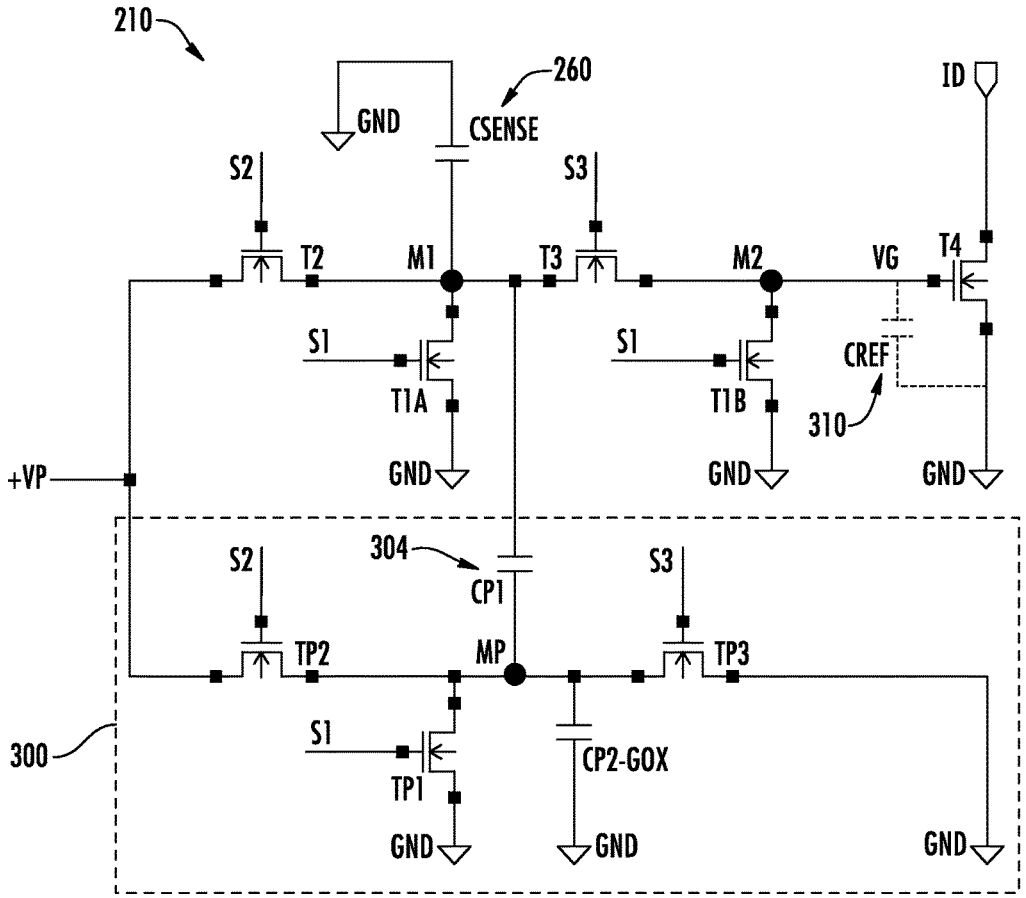
FIG. 6 is a circuit diagram of the fluid level sensor of FIG. 5.

FIG. 6 is a circuit diagram illustrating fluid level sensor 136. In FIG. 5, the parasitic capacitance Cp1 304 is shown coupled between the metal plate 142 (node M1) and the conductive layer 300 (node Mp). Referring to FIGS. 5 and 6, the fluid level sensor 136 with parasitic elimination circuit 300 are driven by non-overlapping clock signals. In a first step, a clock pulse S1 is used to close the transistor switches T1*a*, T1*b* and Tp1. Closing switches T1*a*, T1*b* and Tp1 couples memory nodes M1, M2 and Mp to ground, discharging the sense capacitor (Csense) 260, the reference capacitor (Cref) 310 and the parasitic capacitor (Cp1) 304. In a second step, the S1 clock pulse terminates, opening the T1*a*, T1*b* and Tp1 switches. Directly after the T1*a*, T1*b* and Tp1 switches open, an S2 clock pulse is used to close transistor switches T2 and Tp2. Closing T2 and Tp2 couples nodes M1 and Mp, respectively, to a pre-charge voltage, Vp. This places a charge Q1 across sense capacitor (Csense) 260. However, with nodes M1 and Mp at the same voltage potential, Vp, no charge develops across parasitic capacitor (Cp1) 304.

In a third step, the S2 clock pulse terminates, opening the T2 and Tp2 transistor switches. Directly after the T2 and Tp2 switches open, the S3 clock pulse closes transistor switches T3 and Tp3. Closing switch T3 couples nodes M1 and M2 to one another and shares the charge Q1 between sense capacitor 260 and reference capacitor 310. The shared charge Q1 between sense capacitor 260 and reference capacitor 310 results in a reference voltage, Vg, at node M2 which is also at the gate of evaluation transistor T4. Closing switch Tp3 couples parasitic capacitor (Cp1) 304 to ground. During the S3 clock pulse, parasitic charge on Cp1 304 is discharged, leaving only the sense capacitor 260 to be evaluated with the evaluation transistor T4. Since the effect of the parasitic capacitor (Cp1) 304 is removed, for a dry signal there is a much reduced parasitic contribution to turn on T4.

Figure 7:
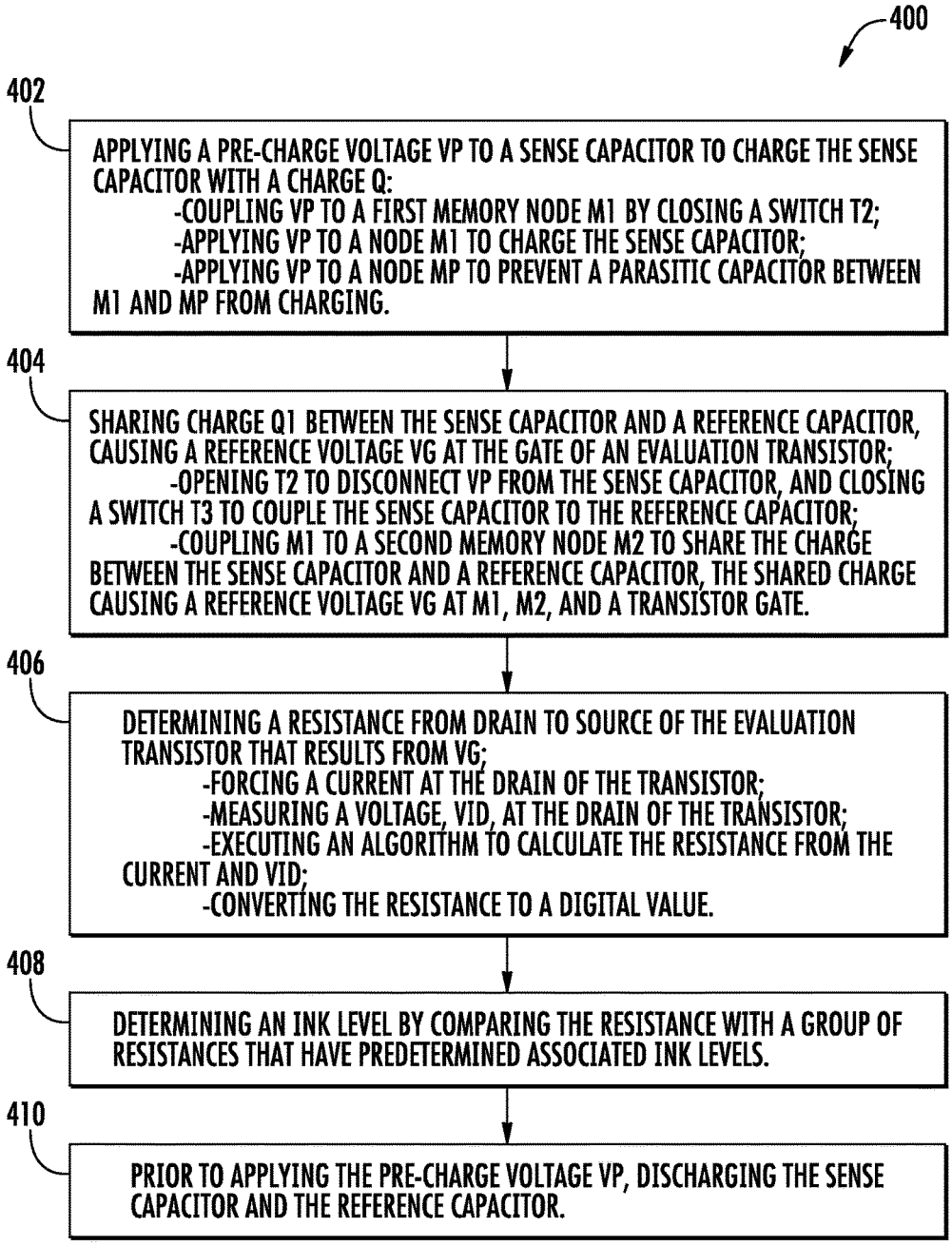
FIG. 7 is a flow diagram of an example method for sensing fluid levels.

FIG. 7 shows a flowchart of an example method 400 of sensing an ink level, according to an embodiment of the disclosure. Method 400 begins at block 402, with applying a pre-charge voltage Vp to a sense capacitor to charge the sense capacitor with a charge Q. Applying Vp to the sense capacitor includes coupling Vp to a first memory node M1 by closing a switch T2. In another embodiment, applying Vp additionally includes applying Vp to a node Mp to prevent a parasitic capacitor between M1 and Mp from charging.

At block 404 of method 400, a charge Q1 is shared between the sense capacitor and a reference capacitor, causing a reference voltage Vg at the gate of an evaluation transistor. Sharing the charge Q1 includes opening T2 to disconnect Vp from the sense capacitor, and closing a switch T3 to couple the sense capacitor to the reference capacitor. The sharing couples M1 to a second memory node M2 to share the charge between the sense capacitor and a reference capacitor, and the shared charge causes the reference voltage Vg at M1, M2, and the transistor gate.

The method 400 continues at step 406 with determining a resistance from drain to source of the evaluation transistor that results from Vg. The resistance is determined by forcing a current at the drain of the transistor, measuring a voltage, Vid, at the drain of the transistor, executing an algorithm to calculate the resistance from the current and Vid, and converting the resistance to a digital value.

At block 408 of method 400, an ink level is determined by comparing the resistance with a group of resistances that have predetermined associated ink levels. At block 410 of method 400, prior to applying the pre-charge voltage Vp, the sense capacitor and the reference capacitor are discharged.

Figure 8:
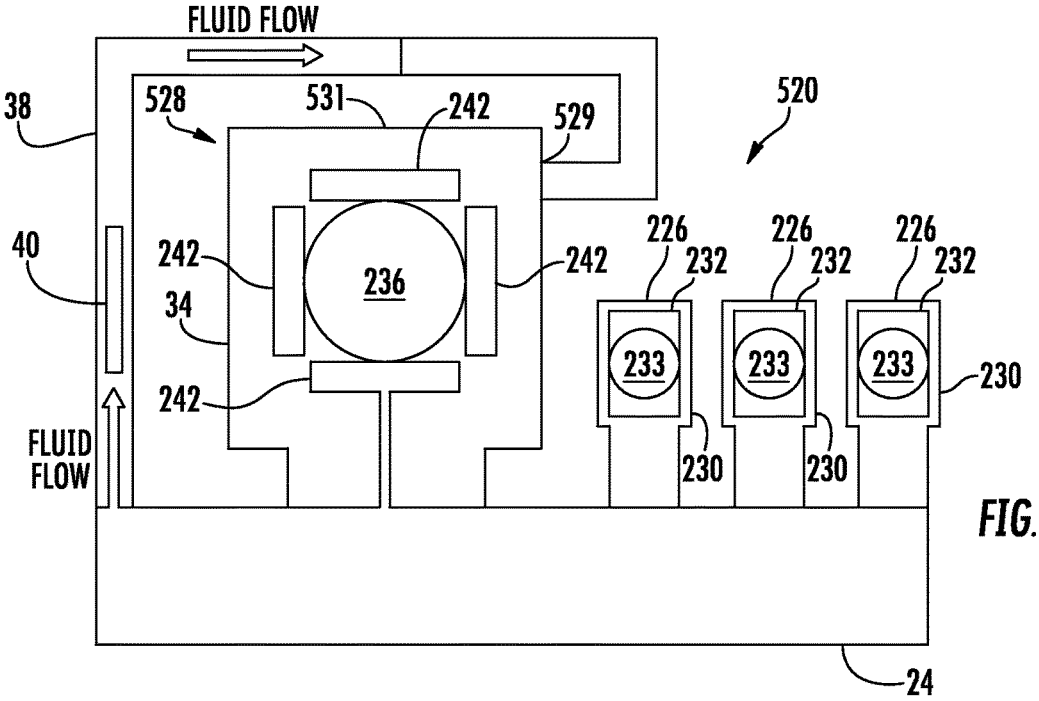
FIG. 8 is a schematic diagram of an example print head for use in the printing system of FIG. 3.

In the example shown in FIG. 4, fluid circulation path or passage 38 is illustrated as passing between sensing chamber 34 and the column of drop generators 126. In other implementations, sensing chamber 34 and fluid circulation path 38 may be provided are formed at other locations. FIG. 8 illustrates print head 520, another implementation of print head 20. Printed 520 is similar to print head 120 except that print head 520 comprises fluid level sensing system 528. Fluid level sensing system 528 is similar to fluid level sensing system 128 except that fluid circulation passage 38 extends about an opposite side of sensing chamber 34 as the column of drop generators 126. As a result, fluid circulation passage 38 interferes to a lesser degree with the layout or arrangement of drop generators 126. Those remaining components are elements of print head 520 and fluid level sensing system 528 which correspond to elements of print head 120 and fluid level sensing system 128 are numbered similarly. Although passage 38 is illustrated as extending from side 529 of chamber 34, in another implementation, passage 38 alternatively extends from side 531 of chamber 34. In yet other implementations, passage 38 extends from or joins to multiple sides of chamber 34.

Figure 9:
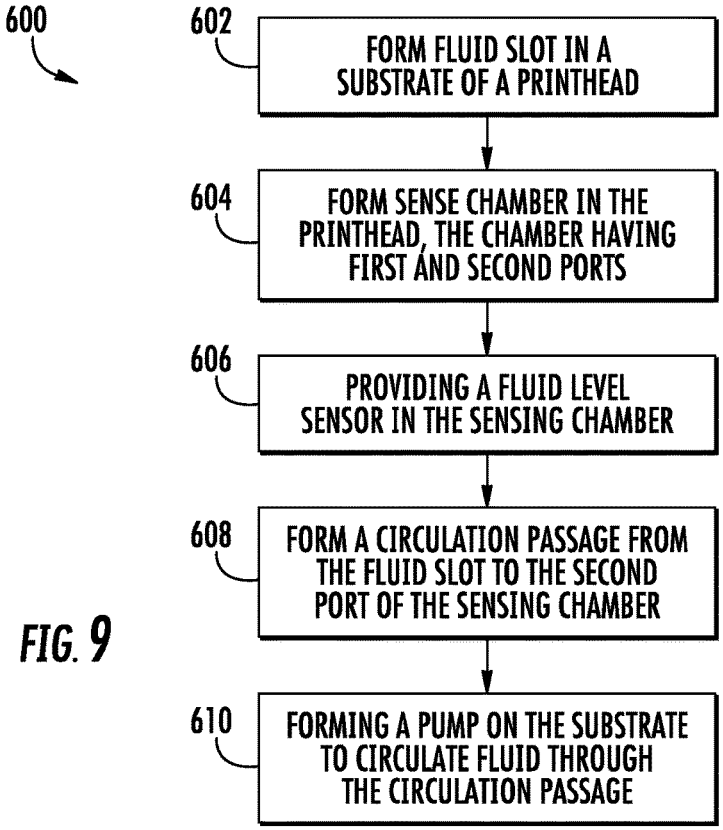
FIG. 9 is a flow diagram of an example method for forming a print head.

FIG. 9 is a flow diagram of an example method 600 for forming a print head. As indicated by block 602, fluid slot 24 is formed in a substrate of the print head. As indicated by block 604, sensing chamber 34 is formed in the print head.

The chamber 34 has first and second ports with the first port being fluidly connected to the fluid slot. As indicated by block 606, fluid level sensor 36, 136 is formed are provided in the sensing chamber 34. As indicated by block 608, circulation passage 38 is formed. Circulation passage 38 extends from fluid slot 24 to the second port of the sensing chamber 34. In one implementation, the circulation passage 38 is formed in the substrate in which the fluid slot and the sense chamber are also formed. As indicated by block 610, a pump 40 is formed on the substrate to circulate fluid through the circulation passage 38. In one implementation, the pump 40 comprises a thermoresistive firing element or a piezoelectric firing element located within passage 38.

Figure 10:
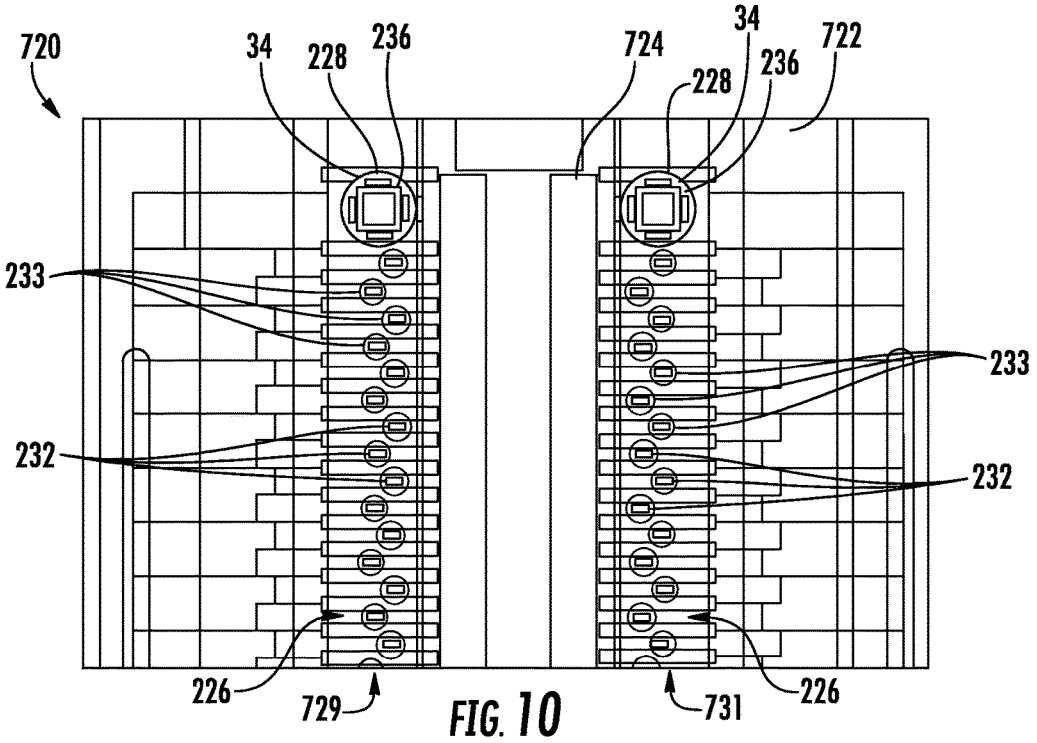
FIG. 10 is a top view of an example print head prior to formation of a circulation passage.
Figure 11:
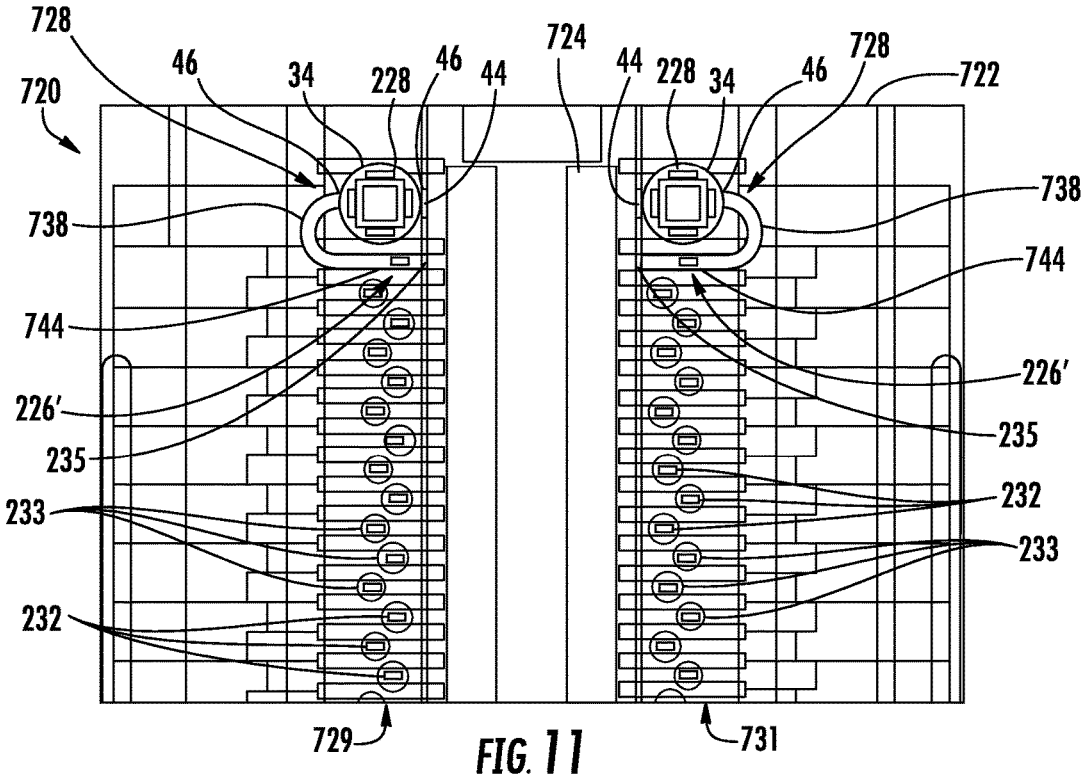
FIG. 11 is a top view of the print head of FIG. 10 following formation of the circulation passage.

FIGS. 10 and 11 illustrate the formation of an example print head 720 according to the method of FIG. 9. As will be described with respect to print head 720 shown completed in FIG. 11, print head 720 comprises a pair of fluid level sensing systems 728. Fluid level sensing systems 728 functions similarly to fluid level sensing system 228 except that fluid level sensing systems 728 utilize slightly modified drop generators 226' as the fluid pump 40 to circulate fluid through and across sensing chamber 34. As a result, the footprint of such fluid level sensing system 728 is reduced. As shown by a comparison of FIGS. 10 and 11, circulation passage 38 and pump 40 are added without substantially impacting the overall size of print head 720 or the layout of the remaining components of print head 720. Consequently, fabrication is facilitated with lower cost.

As shown by FIG. 10, a fluid slot 724 is formed in a substrate 722. Drop generators 226, arranged in two columns 727, 728 are formed on opposite sides of fluid slot 724. For each of columns 729, 731, a sensing chamber 34 is formed. In the example illustrated, sensing chamber 34 is formed at an end of each of columns 729, 731 within each sensing chamber 34, fluid level sensor 136 is further formed.

As shown by FIG. 10, the method illustrated in FIGS. 10 and 11 further comprises the formation of circulation passages 738 in substrate 722. Each of circulation passages 738 extends from port 46 of sensing chamber 34 to a selected drop generator 226'. Unlike the other drop generators 226 of columns 729, 731, the selected drop generators 226' each omit the nozzle opening 233 and include an additional port 744 into the print firing chamber 230. As a result, each of the selected drop generators 226' serves as a pump for circulating fluid or ink from fluid slot 724 into and across their associated sensing chamber 34. Upon being actuated, the firing element 232 of drop generator 226' expels fluid from print firing chamber 230 through port 744 into circulation passage 738 and further into sensing chamber 34 through port 46. Existing fluid or ink within sensing chamber 34, which may have undergone evaporation during decapped operation of print head 720, is pushed and expelled back into fluid slot 724 through port 44. Fluid is further drawn through port 235 into firing chamber 230 to replace the fluid previously expelled through port 744 into circulation passage 738.

Figure 11A:
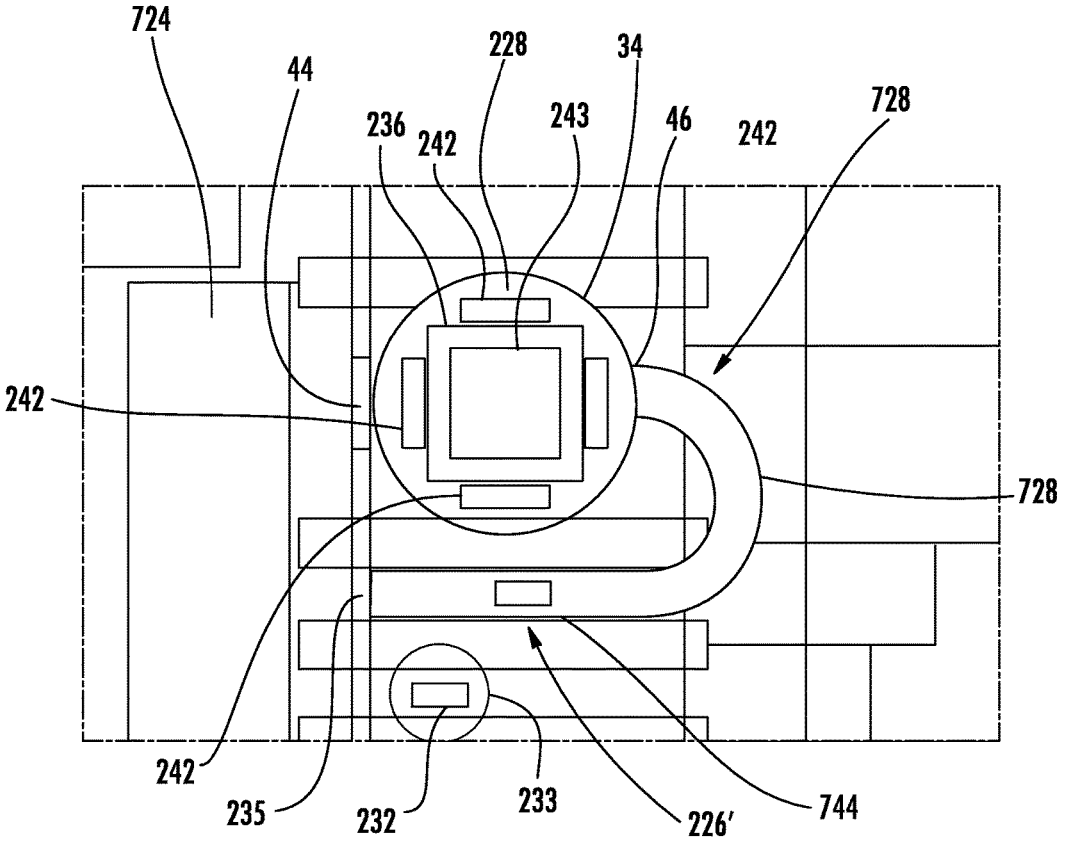
FIG. 11A is an enlarged view of a portion of the print head of FIG. 11.

As shown by FIGS. 11 and 11A, by repurposing drop generators 226' as pumps for circulating fluid through circulation passages 738, across sensing chambers 34 and back to fluid slot 724, fluid sensing system 728 a reduced number of changes to the overall architecture of print head 720. In one implementation, drop generators 226' are identical to the remaining drop generators 226 in each of columns 727, 728 but for the omission of a nozzle opening and four the additional provision of port 744 which connects to circulation passage 738. In other words, the configuration of print firing chamber 230 and firing element 232 of drop generators 226' are identical to the print firing chamber 230 and firing element 232 of the remaining drop generators 226 in columns 727, 728. As a result, the print firing chamber 230 and the firing element 232 of each of drop generators 226' may be fabricated at the same time that such components are formed for the other drop generators 226.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprises:

a print head having a fluid slot and a sensing chamber having a first port connected to the fluid slot and a second port;

a drop generator fluidly coupled to the fluid slot to receive fluid from the fluid slot;

a fluid level sensor within the sensing chamber;

a circulation passage extending from the fluid slot and fluidly coupled to the second port; and a fluid pump, comprising a resistor to vaporize fluid to pump adjacent fluid, to circulate fluid through the circulation passage.

2. The apparatus of claim 1, wherein the ink level sensor comprises a sensor nozzle and a resistor to vaporize fluid within the chamber to expel fluid through the sensor nozzle.

3. The apparatus of claim 1, wherein the print head further comprises a series of printing nozzles, wherein the circulation passage extends between the series of printing nozzles and the sensing chamber.

4. The apparatus of claim 1, where the print head further comprises a series of printing nozzles on a first side of the sensing chamber, wherein the circulation passage extends on a second side of the sensing chamber opposite the first side.

5. The apparatus of claim 1, wherein the print head farther comprises:

a column of print firing chambers, each of the print firing chambers of the column having an inlet connected to the fluid slot, the print firing chambers comprising a first print firing chamber and a second print firing chamber;

a firing resistor within each of the firing chambers; and a firing nozzle adjacent to the first firing chamber, wherein the circulation passage extends from the second print firing chamber to the second port and wherein the firing resistor in the second print firing chamber serves as the pump.

6. The apparatus of claim 5, wherein the first print firing chamber and the second print firing chamber are identical.

7. The apparatus of claim 6, wherein the firing resistor in the first firing chamber and the second firing resistor in the second firing chamber are identical.

8. The apparatus of claim 1, wherein the fluid level sensor comprises a sense capacitor whose capacitance changes with a level of fluid within the sense chamber.

9. A method comprising:

sensing a fluid level within a sensing chamber of a print head; and circulating fluid from a fluid slot of the print head into the sensing chamber through a first port and out of the sensing chamber back into the fluid slot through a second port.

10. The method of claim 9, wherein the sensing comprises sensing capacitance changes of a sense capacitor within the sensing chamber.

11. The method of claim 9, wherein the circulating comprises firing a resistor in one of a column of identical firing chambers to vaporize fluid and pump adjacent fluid into the sensing chamber through the first port.

12. A method comprising:

forming a fluid slot in a substrate;

forming a sensing chamber of a print head, the sensing chamber having a first port connected to the fluid slot and a second port;

providing an ink level sensor within the sensing chamber;

forming a circulation passage from the fluid slot to the second port of the sensing chamber; and forming a pump on the substrate to circulate fluid through the circulation passage.

13. The method of claim 12, wherein the forming of circulation passage comprises extending the circulation passage from a selected firing chamber of a column of identical firing chambers of the print head.

14. The method of claim 13 further comprising forming nozzle openings for each of the identical firing chambers of the column but for the selected firing chamber.

* * * * *